US005804345A

United States Patent [19]

Itami et al.

[11] Patent Number: 5,804,345

[45] Date of Patent: Sep. 8, 1998

[54] PHOTORECEPTOR FOR ELECTROPHOTOGRAPHY

[75] Inventors: Akihiko Itami; Mieko Toyama; Masaru Sano, all of Hachioji, Japan

[73] Assignee: Konica Corporation, Japan

[21] Appl. No.: 962,374

[22] Filed: Oct. 31, 1997

[30] Foreign Application Priority Data

Nov. 8, 1996 [JP] Japan ..... 8-296278

[51] Int. Cl.[6] ..... G03G 5/047; G03G 5/09

[52] U.S. Cl. ..... 430/59; 430/58; 430/83

[58] Field of Search ..... 430/58, 59, 83

[56] References Cited

U.S. PATENT DOCUMENTS

| | | | |
|---|---|---|---|
| 4,563,408 | 1/1986 | Lin et al. | 430/59 |
| 4,931,372 | 6/1990 | Takei et al. | 430/66 |
| 4,943,501 | 7/1990 | Kinoshita et al. | 430/59 |
| 5,213,923 | 5/1993 | Yokoyama et al. | 430/58 |
| 5,474,868 | 12/1995 | Adachi et al. | 430/58 |
| 5,547,790 | 8/1996 | Umeda et al. | 430/58 |
| 5,578,406 | 11/1996 | Ojima et al. | 430/59 |
| 5,707,766 | 1/1998 | Nogami et al. | 430/83 |
| 5,721,081 | 2/1998 | Takagi et al. | 430/59 |

*Primary Examiner*—Roland Martin

*Attorney, Agent, or Firm*—Jordan B. Bierman; Bierman, Muserlian and Lucas

[57] ABSTRACT

An electrophotographic photoreceptor comprising a charge transport material and an anti-oxidant in the charge transport layer is disclosed. The transport material has a carbon atom of which the charge density on aforesaid carbon atom in an aromatic ring is smaller than −0.16 when aforesaid charge transport material is in a positive hole state due to being one electron-oxidation, and the anti-oxidant has oxidation potential (V) satisfying Formula, $$0.1(V) \leq E_{OX} - E_T \leq 1.0(V)$$

wherein $E_{OX}$ is oxidation potential of the anti-oxidant, and $E_T$ is oxidation potential of the charge transport material. The thickness of the charge transport layer is 25 $\mu$m or more.

7 Claims, 1 Drawing Sheet

PHOTORECEPTOR FOR ELECTROPHOTOGRAPHY

FIELD OF THE INVENTION

The present invention relates to an electrophotographic photoreceptor used for copying machines and printers.

BACKGROUND OF THE INVENTION

Recently, in copying machines, printers and facsimiles based on electrophotographic technology, organic photoreceptors have proliferated since dependency on temperature and humidity are low and high speed response can be conducted against semi-conductor laser beams.

In aforesaid electrophotographic photoreceptors, by adopting a function separation type constitution in which a charge generation function and a charge transport function are assigned to substances different each other, a range of suitable materials is extremely broad. Specifically, in the case of organic compounds, multi-diverse designs of chemical structure groups are possible. Therefore, development of excellent materials have been proceeded in both charge generation materials and charge transport materials.

As a charge generation material, various organic dyes and organic pigments have been disclosed. For example, multicyclic quinone compounds typicalized by dibromoanthanthlone, pyrylium compounds and eutectic complexes between a pyrylium compounds and polycarbonate, squarium compounds, phthalocyanine compounds and azo compounds are known.

As a charge transport material, compounds having a nitrogen-containing heterocyclic nuclei typicalized by oxazole, oxadiazole, thiazole, thiadiazole and imidazole and their condensed cyclic nuclei, polyrylalkane-containing compounds, pyrazoline-containing compounds, hydrazone-containing compounds, triarylamine-containing compounds, styryl-containing compounds, styryltriphenylamine-containing compounds, β-phenylstyryltriphenylamine-containing compounds, buthadiene-containing compounds, hexatriene-containing compounds and carbazole-containing compounds are known. The above-mentioned charge transport material have positive hole transportation property.

Heretofore, when a charge generation material and a charge transport material are combined to produce a photoreceptor, a photoreceptor excellent in terms of durability can be obtained when a charge generation layer is provided containing a charge generation material is provided on an electrode and a charge transport layer containing a charge transport material is provided for forming a layer lamination structure. Almost all current organic photoreceptors have the above-mentioned structure.

On the other hand, since the above-mentioned charge transport material has a positive hole transportation property, the surface of a photoreceptor is negatively charged for operation in the above-mentioned electrophotographic photoreceptor. For charging, a corona discharge system in which high speed operation is capable and stable charging property is obtained is ordinarily used.

In the above-mentioned structure, currently, the most serious problem is performance deterioration of the photoreceptor due to oxidizing gas substances such as ozone and $NO_x$ which occur when charging.

SUMMARY OF THE INVENTION

An objective of the present invention is to obtain an electrophotographic photoreceptor having favorable charge transportationability, excellent basic performance of the electrophotoreceptor using the same such as charging property and sensitivity property, high durability of the photoreceptor and excellent durability wherein it is difficult to receive an oxidizing gas such as ozone and $NO_x$ and initial property is maintained for a long time.

An electrophotographic photoreceptor of the present invention and its preferred embodiment will now be described.

An electrophotographic photoreceptor comprises a charge transport material and an anti-oxidant in the charge transport layer and the transport material has a carbon atom of which the charge density on aforesaid carbon atom in an aromatic ring is smaller than −0.16 when aforesaid charge transport material is in a positive hole state due to being one electron-oxidation. The anti-oxidant has oxidation potential in volts satisfying the Formula.

$$0.1 \leqq E_{OX} - E_T \leqq 1.0$$

$E_{OX}$: Oxidation potential of an anti-oxidant in volts $E_T$: Oxidation potential of a charge transport material in volts.

It is preferable that the anti-oxidant is a compound having at least either a hindered amine structural unit or a hindered phenol structural unit in each molecule.

It is preferable that the layer thickness of charge transport layer is 25 μm or more.

The charge transport layer is composed of plural layers, and it is preferable that aforesaid charge transport layer contains a charge transport material and an anti-oxidant satisfying Formula 1 in the outermost layer.

EXPLANATION OF NUMERALS

Figure 1:
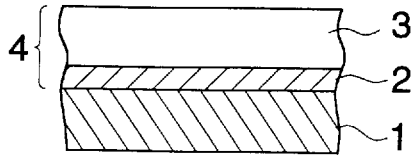
FIG. 1 is a cross sectional view showing a constitution of a photoreceptor of the present invention.
Figure 1:
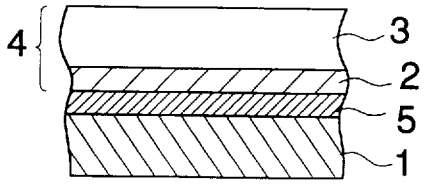
Figure 1:
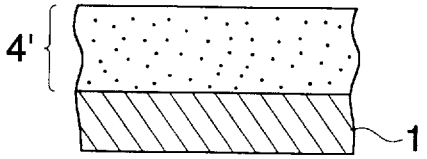
Figure 1:
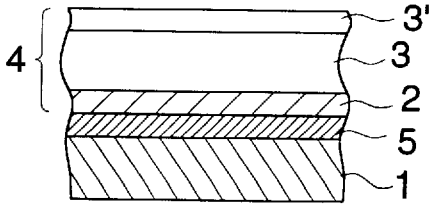

1. Conductive support
2. Charge generation layer
3. Charge transport layer

3' Second charge transport layer

4. Photosensitive layer

4' Photosensitive layer containing a charge generation material and a charge transport material 5. Intermediate layer

DETAILED DESCRIPTION OF THE INVENTION

In a positive hole state which occurs due to that a charge transport material is subjected to one electron oxidation, charge density on an aromatic ring carbon atom is a calculated value calculated by method PM3 using a molecule orbit calculation program "MOPAC ver. 6". The value of the charge density is a system of units in which electron charge is a unit, and a no-unit value.

The charge transport material may have a carbon atom in which the charge density on the aromatic carbon atom is smaller than −0.16 in the positive hole state which occurs due to one electron oxidation.

The compounds are illustrated.

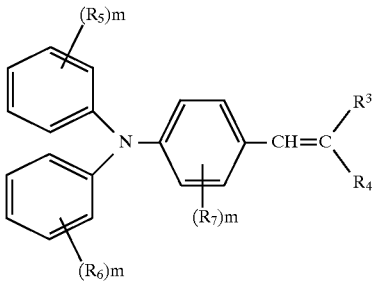

(A)

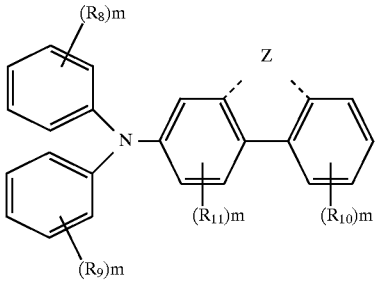

(B)

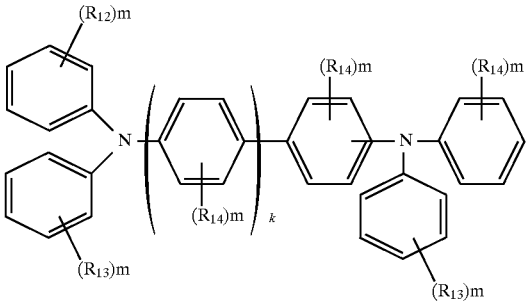

(C)

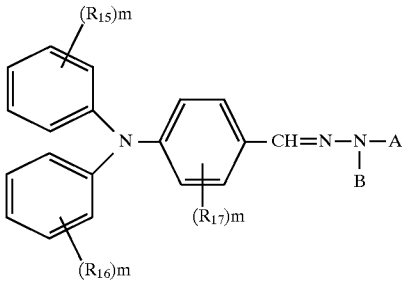

(D)

In the formulas $R_3$ is a phenyl group which may have a substituent, $R_4$ is a hudrogen atom or a phenyl group which may have a substituent, $R_5$ to $R_{17}$ are each represent a hydrogen atom, a halogen atom, alkyl group or alkoxy group. m is an integer of 1 to 3. A and B independently is an alkyl group which may have a substituent or a phenyl group which may have a substituent, and A and B may form a ring in combinanation each other. Z is a bonding group. k is an integer of 0 or 1.

Among the compounds illustrated above, compound represented by formula (A) is preferably used. Typical examples will now be exhibited.

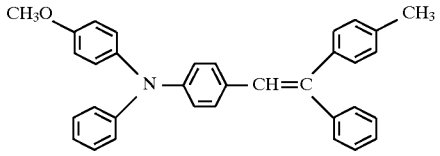

(1)

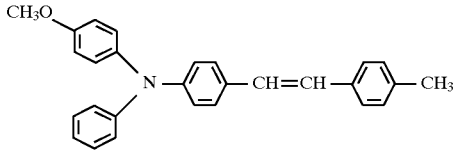

(2)

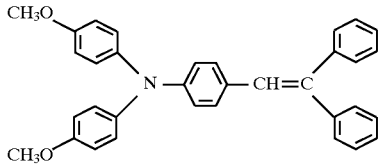

(3)

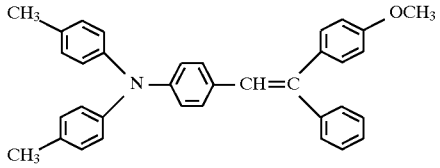

(4)

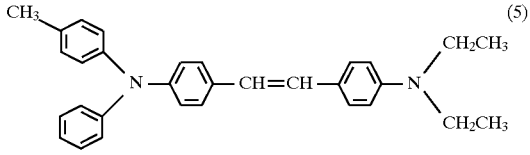

(5)

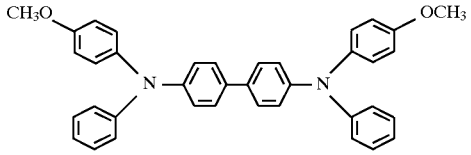

(6)

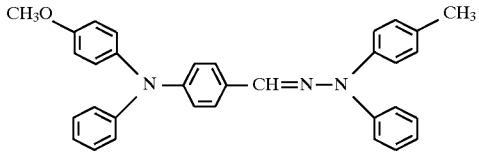

(7)

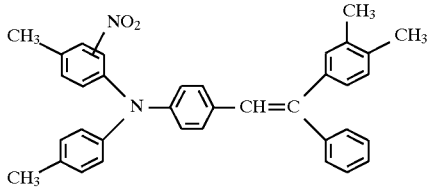

(8)

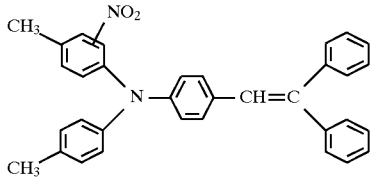

(9)

With regard to electrophotographic photoreceptors, a photosensitive layer surface is damaged due to an influence by an oxidizing gas such as ozone and $NO_x$ which occur inside the machine, causing defective image blurring and resolution reduction and reduction of potential property after repeated use. Specifically, when an organic photoreceptor (OPC) is subjected to an atmosphere under which a high density $NO_x$ gas exists for a long time, reduction of resolution becomes noticeable and improvement of durability against $NO_x$ is in question.

According to investigation by the present inventors, they discovered that resolution reduction is related to cation radical produced due to reaction of a charge transport material in a charge transport layer with $NO_x$ existing in the machine or nitrated charge transport material. This reactivity is prominent in a charge transport material having a large negative charge density on an aromatic ring in a cation radical produced due to one electron oxidizing.

Specifically, when a charge transport material having a high negative charge density, it was discovered not only that resolution reduction can rapidly be improved due to using an anti-oxidant in which the oxidation potential difference between the charge transport material is included in a specific range in combination but also that potential stability when using repeatedly can also be noticeably improved. Aforesaid improvement effects are characteristic behavior of a charge transport material having a large negative charge density. Specifically, the effects are prominent in the charge transport material having a carbon atom of smaller than −0.16 V, and particularly smaller than −0.2 V.

In order to maintain an appropriate residual potential and high resolution, it is preferable that the oxidation potential difference with the anti-oxidant is 0.1 V–1.0 V, more preferably 0.2 V–0.5 V. Therefore, it is preferable to use an anti-oxidant satisfying the relation of Formula 1 with a charge transport material having an aromatic group carbon atom in which the charge density is smaller than −0.16 V.

The amount of the anti-oxidant is preferably 0.01–50 wt % and more preferably 0.1–25 wt % compared with the charge transport material.

In order to increase sensitivity of an organic photoreceptor, the thickness of the charge transport layer, specifically the photosensitive layer, may be increased. In order to maintain performances even when aforesaid layer is worn out due to scraping by a cleaning blade, it is essential that there is a thickness to some extent. Due to this, physical scratches on the charge transport layer which constitutes the upper layer of a multilayered type photoreceptor, i.e., reduction of not a large layer thickness is overcome. In this meaning, durability can be improved. Therefore, for affecting the present invention, it is preferable to arrange the layer thickness of the charge transport layer thicker than usual, i.e., 25 μm or more. Due to combining with the present invention, improvement of durability is contrived in a broad meaning. Accordingly, effects of the present invention can more effectively be utilized.

When the layer thickness of the charge transport layer is preferably not more than 40 μm for obtaining the above-mentioned effects and convenience on coating the charge transport layer.

As an anti-foggant used for the present invention, those suitable for the above-mentioned conditions are used. Examples of compounds preferably used include those having a hindered amine structural unit or a hindered phenol structural unit or having both units, organic phosphoric compounds or organic sulfur-based compounds.

Examples of a compound having a hindered phenol structural unit 1-1

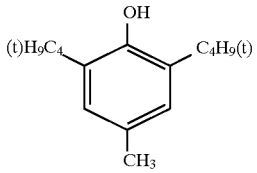

1-2

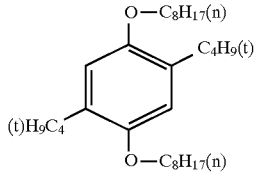

1-3

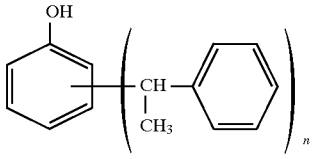

1-4

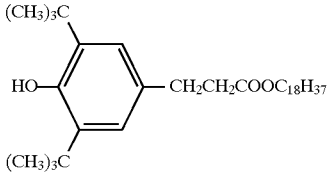

1-5

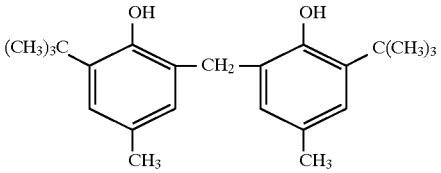

1-6

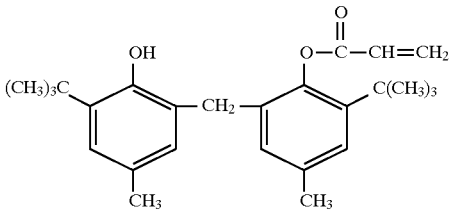

1-7

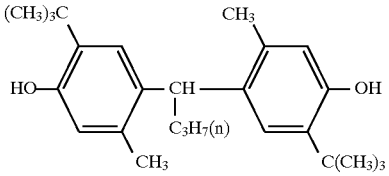

1-8

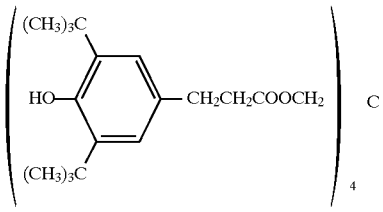

-continued
1-9
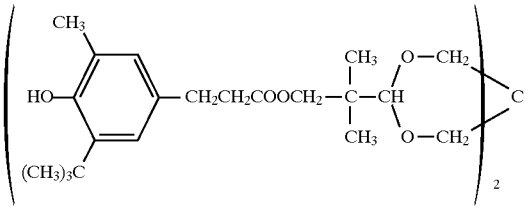
1-10
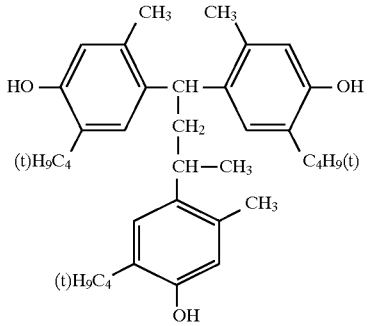
1-11
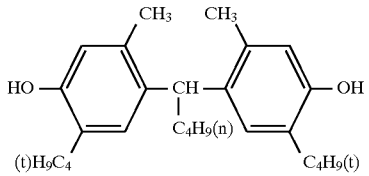
1-12
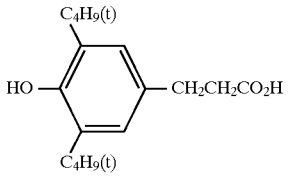
1-13
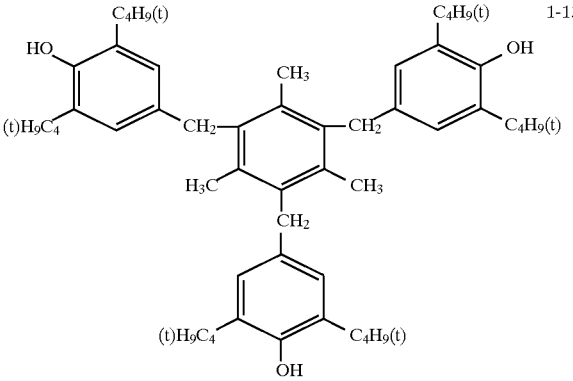
1-14
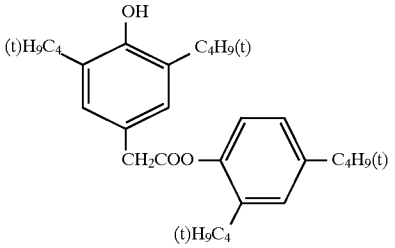
1-15
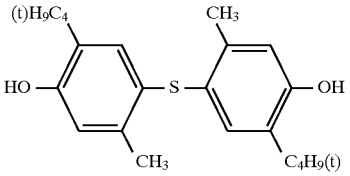
1-16
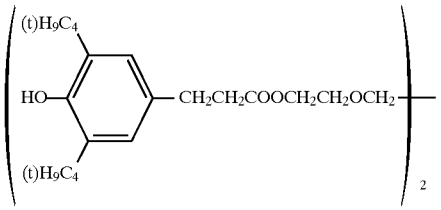
1-17
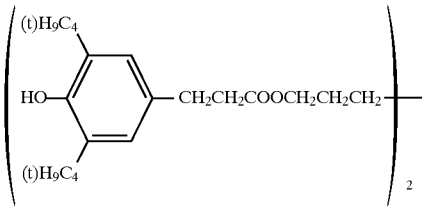
1-18
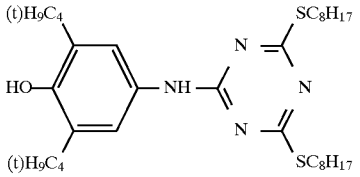
1-19
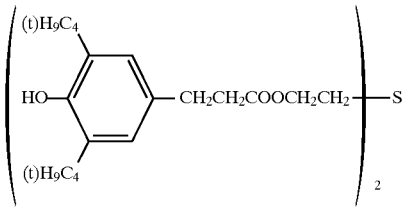
1-20
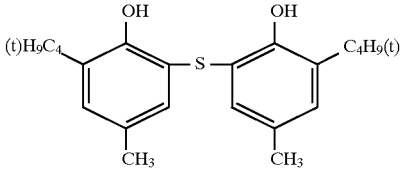

-continued
1-21
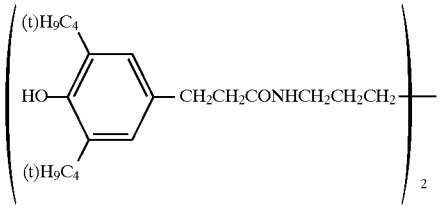
1-22
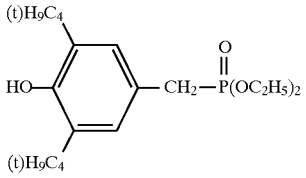
1-23
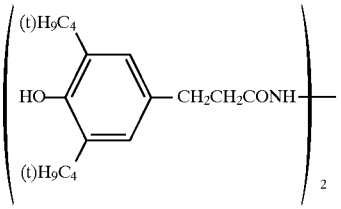
1-24
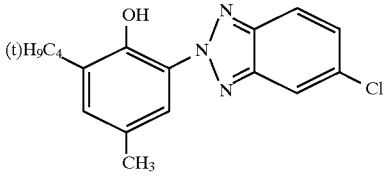
1-25
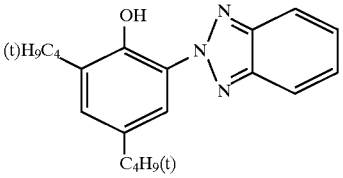
1-26
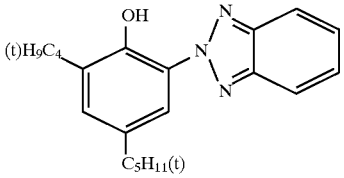
1-27
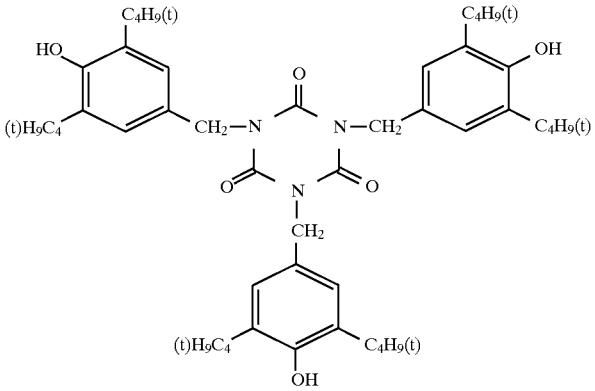
1-28
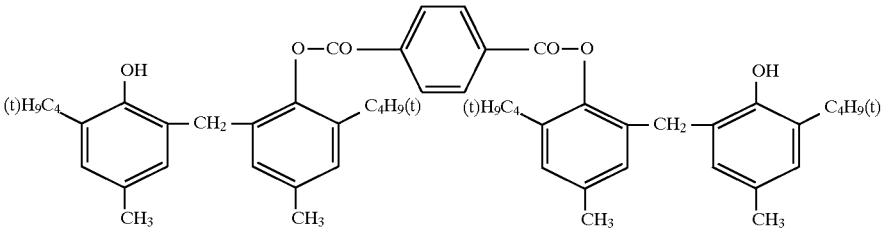
1-29
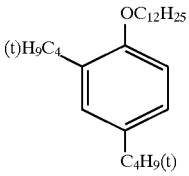
1-30
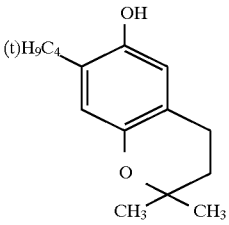
1-31
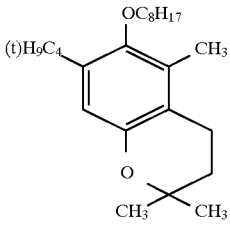
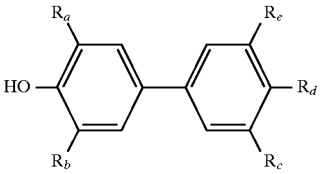

-continued
| | $R_a$ | $R_b$ | $R_c$ | $R_d$ | $R_e$ |
|---|---|---|---|---|---|
| 1-32 | $C_4H_9(t)$ | $C_4H_9(t)$ | H | H | H |
| 1-33 | $C_4H_9(t)$ | $C_4H_9(t)$ | H | $CH_3$ | H |
| 1-34 | $C_4H_9(t)$ | $C_4H_9(t)$ | $C_4H_9(t)$ | H | $C_4H_9(t)$ |
| 1-35 | $C_4H_9(t)$ | $C_4H_9(t)$ | $C_4H_9(t)$ | OH | $C_4H_9(t)$ |
| 1-36 | $C_4H_9(t)$ | H | H | H | H |
| 1-37 | $C_5H_{11}(t)$ | $C_5H_{11}(t)$ | H | H | H |
| 1-38 | $C_5H_{11}(t)$ | H | H | H | H |
| 1-39 | $C_4H_9(t)$ | $CH_3$ | H | H | H |
1-40
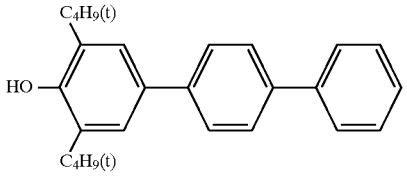
1-41
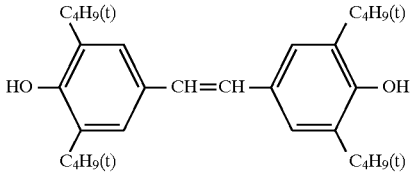
1-42
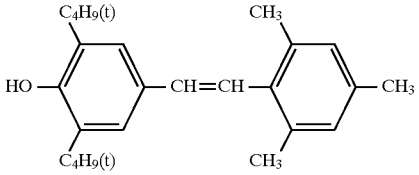
1-43
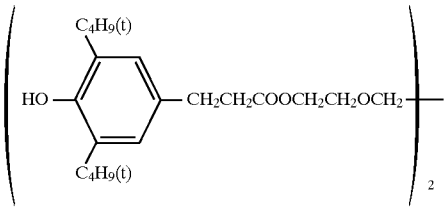
1-44
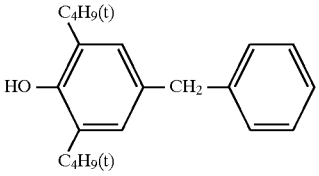
1-45
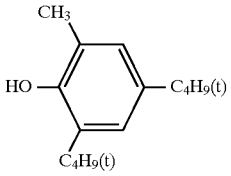
1-46
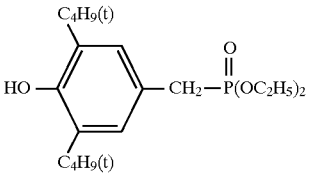
1-47
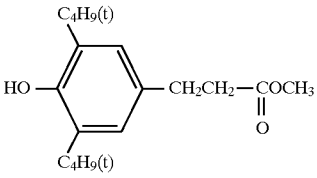
1-48
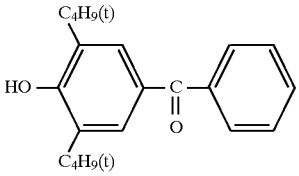
1-49
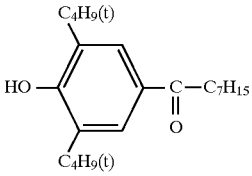
1-50
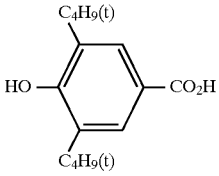
1-51
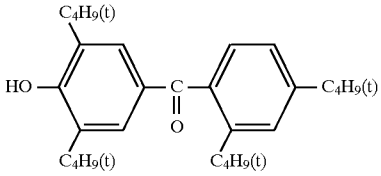
1-52
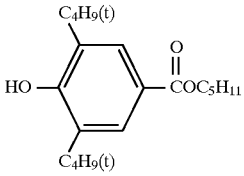
1-53
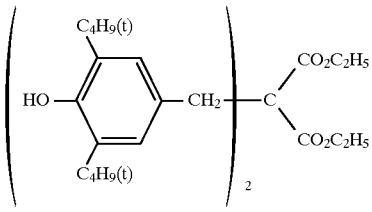

-continued
1-54
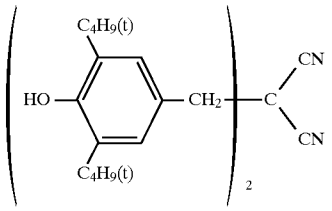
1-55
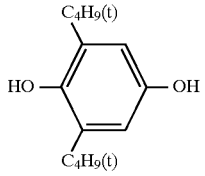
1-56
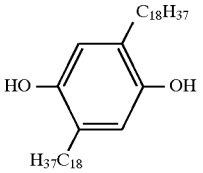
1-57
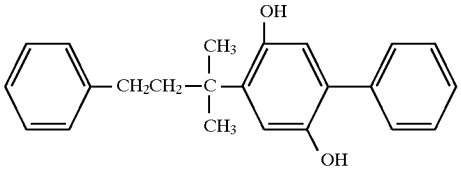
1-58
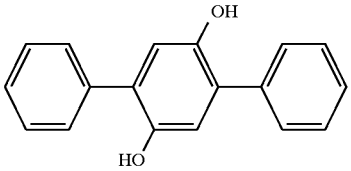
1-59
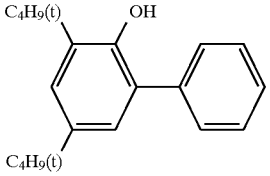
1-60
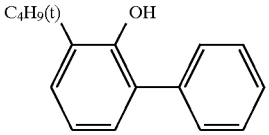
1-61
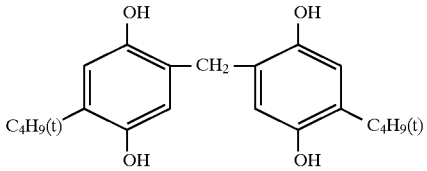
1-62
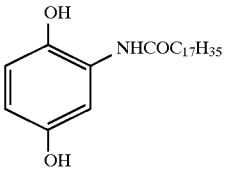
1-63
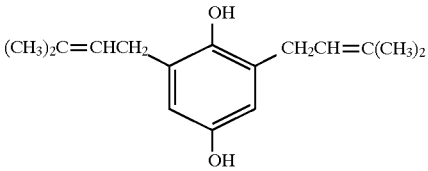
Example of compounds having a hindered amine structural unit and a hindered phenol structural unit.
2-1
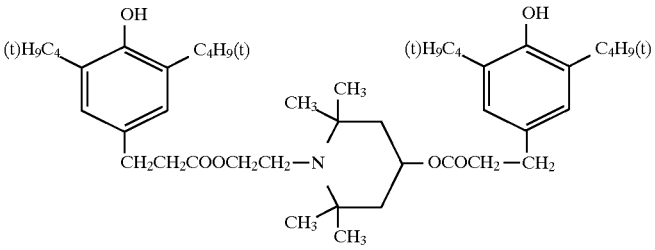
2-2
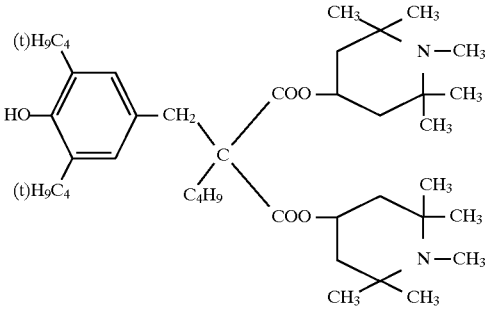

-continued
2-3
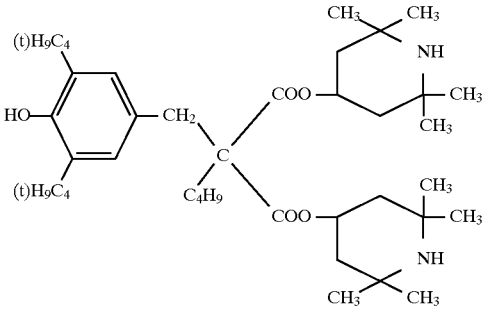
2-4
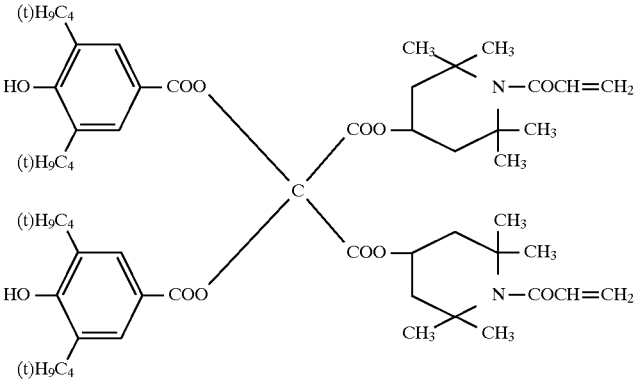
2-5
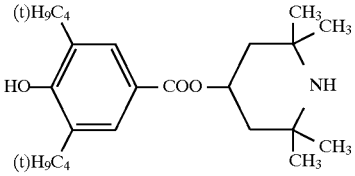
2-6
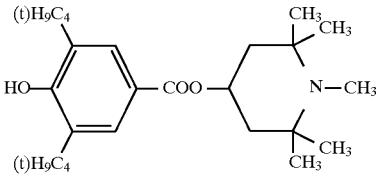
2-7
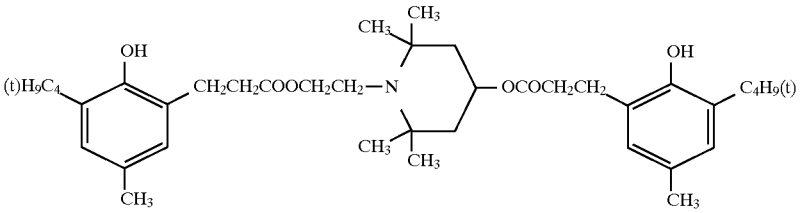
2-8
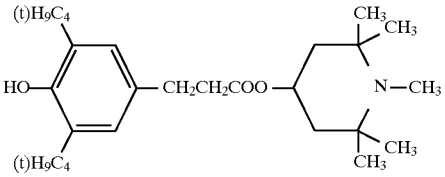
2-9
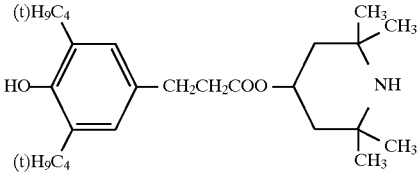

-continued

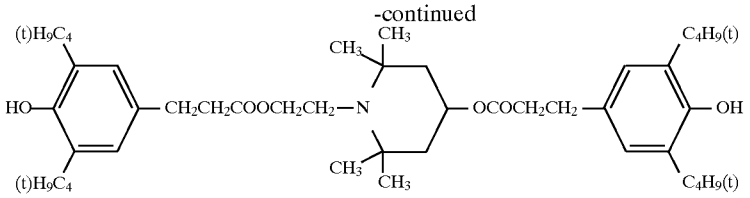

2-10

Examples of organic phosphorine-containing compounds.

For example, as compounds represented by RO—P(OR)—OR, the following compounds are cited. Wherein, R represents a hydrogen atom, a substituted or unsubstituted alkyl group, alkenyl group or an aryl group.

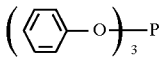

3-1

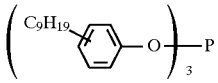

3-2

$(C_2H_5O)_3P$ 3-3

$(C_8H_{17})_3P$ 3-4

$(C_{10}H_{21}O)_3P$ 3-5

$(C_{13}H_{27}O)_3P$ 3-6

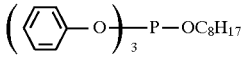

3-7

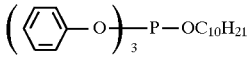

3-8

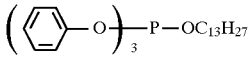

3-9

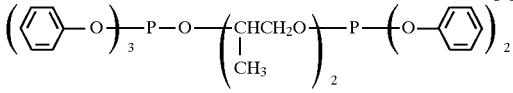

3-10

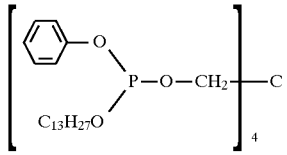

3-11

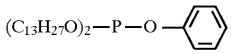

3-12

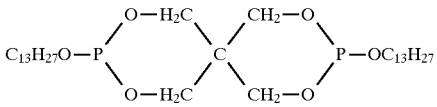

3-13

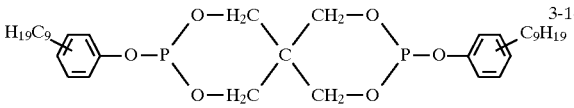

3-14

$(C_{18}H_{35}O)_3P$ 3-15

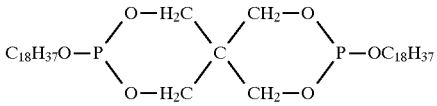

3-16

-continued

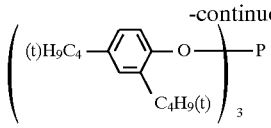

3-17

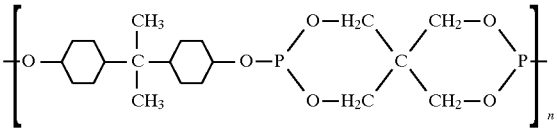

3-18

Organic sulfur-containing compound

As compounds represented by R—S—R, the following compounds are cited. Wherein, R represents a hydrogen atom, a substituted or unsubstituted alkyl group, alkenyl group or an aryl group.

$(C_8H_{17}OCOCH_2CH_2)_2S$ 4-1

$(C_{10}H_{21}OCOCH_2CH_2)_2S$ 4-2

$(C_{12}H_{25}OCOCH_2CH_2)_2S$ 4-3

$(C_{14}H_{29}OCOCH_2CH_2)_2S$ 4-4

$(C_{18}H_{37}OCOCH_2CH_2)_2S$ 4-5

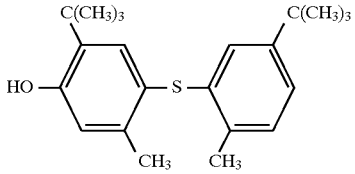

4-6

A photoreceptor is desirable to comprise a support provided thereon with a charge generation layer and a charge transport layer in this order.

FIGS. 1(*a*) through (*d*) exhibit cross sectional views showing typical constitutions. In the case of FIG. 1 (*a*), charge generation layer 2 was formed on conductive support 1, on which charge transport layer 3 was formed for forming photosensitive layer 4. FIG. 1(*b*) provided intermediate layer 5 between photosensitive layer 4 having layer structure as shown in FIG. 1(*a*) and conductive support 1. FIG. 1(*c*) formed photosensitive layer 4' containing a charge generation material and a charge transport material.

FIG. 1(*d*) has almost the same constitution as FIG. 1(*b*). However, in (d), charge transport layer 3 is divided into two layers. A preferable results can be obtained by a constitution as in (d) having second charge transport layer 3' containing a charge transport material having a carbon atom in which the charge density on an aromatic carbon atom under a positive hole state which occurs due to one electron oxidizing and an anti-oxidant having oxidized potential (V) in the range represented by Formula 1.

In any of these layer structures, a protective layer may be provided on a surface layer.

For forming a photosensitive layer, methods to coat a coating composition prepared in advance by means of a dip coating, spray coating, bar coating, roll coating, blade coating and an applicator coating and drying or a method to form a photosensitive layer by means of vacuum deposition.

Coating composition for charge generation layer can be prepared singly or together with a binder or an additive in a dispersing device such as an ultrasonic wave dispersion machine, a ball mill, a sand mill or a homo-mixer. It is ordinary that a coating composition for charge transport layer is prepared by dissolving a charge transport material with a suitable binder and by adding an additive as necessary.

As a solvent used for coating, for example, acetone, methylethylketone, cyclohexanone, tetrahydrofurane, dioxane, acetic acid ethyl, acetic acid butyl, methylcelsolve, ethylcelsolve, ethyleneglycol dimethylether, toluene, xylene, acetophenone, chloroform, dichloromethane, dichloroethan, trichloroethane, methanol, ethanol, propanol and buthanol are cited.

As a binder capable of being used for forming a charge generation layer or a charge transport layer, for example, the following materials are cited.

polycarbonate, polycarbonate Z resin,
acrylic resin, methacryl resin,
polyvinyl chloride, polyvinylidene chloride,
polystyrene, styrene-buthadiene copolymer,
polyvinyl acetic acid, polyvinyl formal,
polyvinyl butylal, polyvinylacetal,
polyvinyl carbazole, styrene-alkid resin,
silicone resin, silicone-alkid resin,
polyester phenol resin,
polyurethane, epoxy resin,
vinylidene chloride—acronitrile copolymer,
vinyl chloride—vinyl acetic acid copolymer,
vinyl chloride—vinyl acetic acid—maleic acid anhydride copolymer The ratio of charge generation material on a binder is preferably 1/9–9/1 weight ratio and more preferably 1/2–6/1 weight ratio.

The thickness of charge generation layer is 0.01–20 μm, and preferably 0.05–5 μm.

In a charge transport layer, the ratio of the charge transport material to the binder is a 1/5–2/1 weight ratio and preferably a 1/4–1/1 weight ratio.

As a binder used for an intermediate layer and a protective layer, those used for the above-mentioned charge generation layer and a charge transport layer can be used. In addition, ethylene-containing resins such as a polyamide resin, a nylon resin, an ethylene-vinyl acetic acid copolymer, an ethylene-vinyl acetic acid—maleic acid anhydride copolymer and an ethylene-vinylacetic acid-methacrylic acid copolymer, polyvinyl alcohol and cellulose derivatives are used. In addition, hardening-type binders utilizing thermo-hardening or chemical-hardening such as meramine, epoxy and isocyanate can be used.

In a photosensitive layer, various additives can be incorporated for improving in terms of potential property, storage stability, durability and environmental dependency.

As a conductive support, a metal plate or a metal drum are used. In addition, metal thin layer such as a conductive compound such as a conductive polymer and indium oxide or aluminum and palladium is provided on a substrate such as paper or a plastic film by means of coating, depositing and laminating.

EXAMPLES

Hereinafter, the present invention will be explained in detail referring to Examples.

An aluminum drum whose diameter was 80 mm was dipped in a coating composition in which 2 wt % of denaturated type polyamide resin "X-1874M" (produced by Dai-Cellu Heurus Co., Ltd.) was dissolved in a mixed solvent composed of 90 parts by volume of methanol and 10 parts by volume of buthanol for forming an intermediate layer whose thickness was 0.3 μm.

Next, 0.8 part by weight of polyvinyl butyral resin "Eslec BX-L" (produced by Sekisui Chemical Co., Ltd.) was dissolved in 100 parts by volume of methylisopropylketone. The above-mentioned intermediate layer was subjected to dip coating in a coating composition in which 2.2 parts by weight of charge generation substance exhibited by the following structural formula was mixed in the resulting solution for dispersion so that a charge generation layer whose layer thickness after being dried is 0.2 μm was formed.

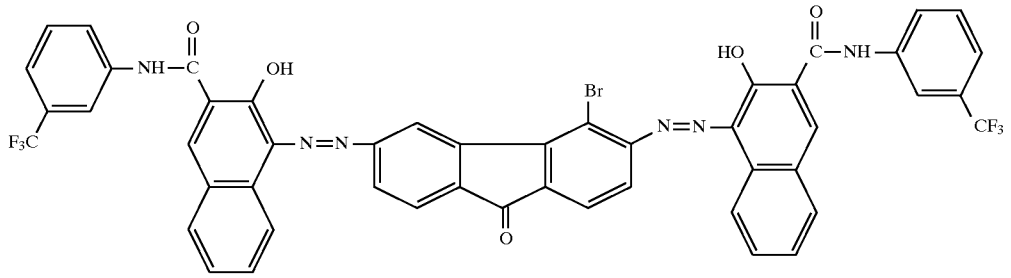

The above-mentioned charge generation layer was subjected to dip coating in a coating composition in which 15 parts by weight of polycarbonate resin "Yupiron Z-300" (produced by Mitsubishi Gas Chemical), 10 parts by weight of charge transport material represented by the following structural Formula and 0.5 parts by weight of an anti-oxidant "Sanol LS-2626 (produced by Sankyo Co., Ltd.) were dissolved in 100 parts by volume of 1,2-dichloroethane for forming a charge transport layer whose layer thickness after being dried was 27 μm was formed. Here, the oxidation potential of the charge transport material was 0.52 V. With regard to the oxidation potential of the anti-oxidant, Table 1 shows the results measured.

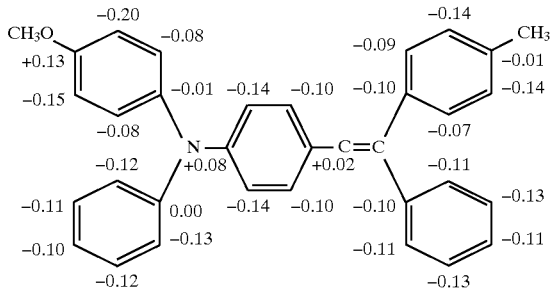

The charge distribution of an aromatic group carbon atom when the charge transport material is under one electron-oxidized cation radical state was as follows. Among this, the charge density of a carbon atom to which a methoxy group in a triphenylamine unit was substituted exhibited—0.20.

Examples 2–8

Photoreceptors 2 through 8 were obtained in the same manner as in Example 1 except that an anti-oxidant in Example 1 was changed as shown in Table 1.

A photoreceptor was obtained in the same manner as in Example 1 except that the layer thickness of the charge transport layer was changed to be 20 $\mu$m.

A photoreceptor was produced in the same manner as in Example 1 except that a material having the following structure (the oxidation potential was 0.59 V) was used as a charge transport material. In the charge transport material having the following structure, no aromatic carbon atom in which the charge density is smaller than −0.16 existed.

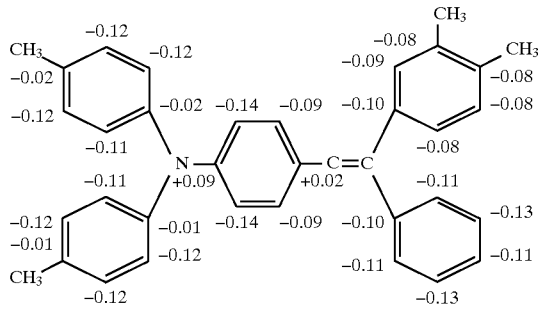

Comparative Example 2

A photoreceptor was obtained in the same manner as in Comparative example 1 except an anti-oxidant was not used.

Comparative Example 3

A photoreceptor for a comparative example was obtained in the same manner as in Comparative Example 1 except an anti-oxidant was not used.

Comparative Examples 4 and 5

A photoreceptor for a Comparative Example was obtained in the same manner as in Comparative Example 1 except an anti-oxidant was changed to agents as shown in Table 1.

Example 10

In Example 1, a charge generation layer was subjected to dip coating in a coating composition in which 15 parts by weight of polycarbonate resin "Yupiron Z-300" (produced by Mitsubishi Gas Chemical) and 10 parts by weight of charge transport material were dissolved in 100 parts by volume of 1,2-dichloroethane for forming a charge transport layer whose layer thickness after being dried was 20 $\mu$m was formed.

By the use of a coating composition in which 6 parts by weight of a polycarbonate resin "Yupiron Z-800" (produced by Mitsubishi Gas Chemical Co., Ltd.), 4 parts by weight of charge transport material and 0.8 parts by weight of anti-oxidant were dissolved in 90 parts by volume of dichloromethan, by means of a circular amount regulation coating, a second charge transport layer having a layer thickness after being dried was 7 $\mu$m was formed for obtaining a photoreceptor for Example.

<Evaluation 1>

Several photoreceptors thus obtained were employed in an analogue type electrophotographic copying machine "Konica U-BIX 4145" having a charging step, an image exposure step, a developing step, a transfer step, a discharge step and a cleaning step in which at least a photoreceptor and a cleaning means are integrally unitized. At normal temperature and a normal humidity (20° C. and 60% RH), each photoreceptor was subjected to image forming test for evaluating an image stability against an amount of potential variation and an oxidizing gas.

1) Measurement on potential variation amount

Photoreceptors were successively loaded on the above-mentioned copying machine. A document having an intermediate tone was subjected to copying for 100,000 copies. In this occasion, as a charger, a scorotron charger was used. By means of a grid control, each of the above-mentioned photoreceptor was subjected to image formation under a certain charging conditions at −750 V.

Black paper potential (Vb) and white paper potential (Vw) before and after an image forming test of 10,000 copies. From each difference ΔVb and ΔVw, potential variation amount of each photoreceptor before and after copying was calculated. Table 1 shows the results thereof. As a document for measurement, a document having a fully black region of 1.3 reflective density and a fully white region of 0.0 reflective density half by half was employed. After charging at −750 V by means of a scorotron charger, an electrostatic latent image formed by image exposure from the document was measured by means of a potentiometer located at the position of the developing device. Accordingly, black paper potential (Vb) and a white paper potential (Vw) were measured. The obtained data after 10,000 cpies and 100,000 copies are summarized in Table 1.

2) Image stability against an oxidizing gas

The photoreceptor samples were left for 30 minutes under the existence of $NO_2$ gas of 5 ppm. With regard to the images before and after leaving, change of resolution was measured. Resolution was evaluated by means of the number of thin lines discernible per 1 mm.

TABLE 1

| | Anti-oxidant Kind | E(V) | ΔE (V) | After 10,000 copies ΔVb (-V) | After 10,000 copies ΔVw (-V) | After 100,000 copies ΔVb (-V) | After 100,000 copies ΔVw (-V) | Resolution (line/mm) First time | Resolution (line/mm) Second time | Image after 100,000 copies |
|---|---|---|---|---|---|---|---|---|---|---|
| Example 1 | 2-10 | 0.88 | 0.36 | 11 | 38 | 25 | 64 | 8.0 | 6.0 | Good |
| Example 2 | 1-1 | 0.66 | 0.14 | 7 | 57 | 21 | 83 | 9.0 | 6.5 | Good |
| Example 3 | 1-2 | 0.91 | 0.39 | 11 | 44 | 21 | 77 | 8.5 | 6.0 | Good |
| Example 4 | 1-3 | 0.80 | 0.28 | 8 | 51 | 20 | 78 | 8.5 | 6.0 | Good |
| Example 5 | 1-32 | 1.04 | 0.52 | 10 | 21 | 31 | 55 | 7.5 | 5.5 | Good |
| Example 6 | 2-2 | 1.34 | 0.82 | 24 | 15 | 39 | 52 | 7.0 | 5.0 | Good |
| Example 7 | 3-17 | 1.47 | 0.95 | 10 | 18 | 44 | 56 | 7.5 | 5.0 | Good |
| Example 8 | 4-6 | 1.51 | 0.99 | 13 | 17 | 45 | 53 | 7.5 | 5.0 | Good |
| Example 9 | 2-10 | 0.88 | 0.36 | 15 | 60 | 22 | 93 | 7.5 | 6.0 | Good |
| Example 10 | 2-10 | 0.88 | 0.36 | 10 | 24 | 17 | 37 | 8.5 | 7.5 | Good |
| Comp. 1 | 2-10 | 0.88 | 0.29 | 38 | 35 | 79 | 113 | 7.0 | 2.5 | Fogging |
| Comp. 2 | — | — | — | 36 | 58 | 92 | 102 | 7.0 | 2.0 | Fogging |
| Comp. 3 | — | — | — | 88 | 24 | 159 | 80 | 2.0 | 1.0 | Blur image |
| Comp. 4 | 1-45 | 0.58 | 0.06 | 5 | 121 | 28 | 253 | 7.5 | 6.0 | Fogging |
| Comp. 5 | 1-9 | 1.60 | 1.08 | 84 | 24 | 178 | 81 | 2.5 | 1.0 | Blur image |

ΔE = (Oxidizing potential of an anti-oxidant) − (Oxidizing potential of charge transport material)

According to the results shown by Table 1, photoreceptors having a large variation (ΔVb) of black paper potential has noticeable reduction of resolution. In the case of photoreceptor for Examples, fluctuation of ΔVb is noticeably reduced due to adding of an appropriate amount of an anti-oxidant.

In the case of photoreceptors having a large white paper potential (ΔVw), defective images such as fogging tends to occur during repetitive using. Accordingly, in order to obtain stable images for a long period, it is desired that both of ΔVb and ΔVw are low. From this issue, it can be understood that charge transport materials of Comparative Examples 1 and 2 exhibit the effect of combined use of anti-oxidants and that, in the case of Comparative Examples 4 and 5, sufficient effects cannot be obtained not by anti-oxidants having appropriate oxidation potentials.

On the contrary, it can be understood from Table 1 that potential fluctuation amount during a repetitive image formation process is reduced by the addition of an anti-oxidant in Example employing each photoreceptor for Example use, a sharp image was obtained even under the presence of an oxidizing gas and noticeable effects were obtained by providing several charge transport layer as is seen in Example 10.

An aluminum drum having a 80 mm was subjected to dip coating by the use of a coating composition in which 13.3 parts by weight of titanium chelate compound TC-750 (produced by Matsumoto Seiyaku) and 7.4 parts by weight of silane coupling agent KBM-503 (produced by ShinEtsu Chemical) and the resulting mixture was mixed with 2-propanol. The coated drum was subjected to heat processing for 30 minutes at 120° C. for obtaining an intermediate layer having 1.0 μm.

Next, 4 parts by weight of type Y titanylphthalocyanine, 45 parts by weight of silicone resin KR-5240 (produced by ShinEtsu Chemical) and 100 parts by weight of 2-buthanone were mixed. The resulting mixture was dispersed in 10 hours for obtaining a charge generation layer coating composition.

The above-mentioned intermediate layer was subjected to aforesaid coating composition for obtaining a charge generation layer having 0.25 μm thickness.

Next, by the use of a coating composition for charger transport layer of Example 1, a charge transport layer having 25 μm was formed on the above-mentioned charge generation layer for preparing a photoreceptor.

Comparative Examples 6–8

In the same manner as in Example 11 except that charge transport layers of 25 μm of Comparative Examples 1 through 3 were formed on the charge generation layer, a photoreceptor was prepared.

Comparative Example 9

In the same manner as in Example 11 except that the layer thickness of the charge transport layer was arranged to be 20 μm, a photoreceptor was prepared.

<Evaluation 2>

An electrophotographic copying machine "Konica U-BIX 4145" employed in Evaluation 1 was modified to a digital image exposure type by the use of a semi-conductor light source (780 nm) to be used. In the same manner as in Evaluation 1, an image forming test of 10,000 copies was conducted for each of photoreceptor under normal temperature and normal humidity (20° C. and 60% RH) for evaluating image stability against potential fluctuation amount and oxidizing gas.

1) Measurement on potential fluctuation amount

Potential of unexposed portion before and after image forming test for the above-mentioned 10,000 copies ($V_H$) and the potential of exposure portion at fully lighting time of exposure light ($V_L$) were measured. Table 2 shows the results thereof.

2) Image stability against an oxidizing gas

Before and after leaving the above-mentioned photoreceptor for 30 minutes in the presence of $NO_2$ gas of 5 ppm. Resolution was evaluated by the number of thin lines discernible per 1 mm.

TABLE 2

| | Anti-oxidant Kind | E(V) | ΔE (V) | After 10,000 copies ΔVb (-V) | After 10,000 copies ΔVw (-V) | After 100,000 copies ΔVb (-V) | After 100,000 copies ΔVw (-V) | Resolution (line/mm) First time | Resolution (line/mm) Second time | Image after 100,000 copies |
|---|---|---|---|---|---|---|---|---|---|---|
| Example 11 | 2-10 | 0.88 | 0.36 | 8 | 18 | 20 | 38 | 8.5 | 7.0 | Good |
| Comp. 6 | 2-10 | 0.88 | 0.29 | 12 | 25 | 62 | 94 | 7.5 | 3.0 | Blur image |
| Comp. 7 | — | — | — | 11 | 33 | 71 | 90 | 7.5 | 2.5 | Blur image |
| Comp. 8 | — | — | — | 65 | 26 | 105 | 68 | 3.0 | 1.5 | Blur image |
| Comp. 9 | 2-10 | 0.88 | 0.36 | 17 | 30 | 36 | 75 | 8.5 | 5.0 | Blur image |

From Table 2, in a photoreceptor of Example 11, due to the addition of an anti-oxidant, an image having small potential fluctuation amount during repetitive image forming and sharp even under an oxidizing gas was obtained. From comparison between Examples 11 and 12, it is seen that the photoreceptor having the layer thickness of the charge transport layer was 25 μm is excellent in terms of potential stability after repetitive using. However, in the case of photoreceptor 6 for Comparative Example, no improvement effect due to the addition of anti-oxidant were seen.

Owing to the present invention, methods to enhance durability of a photoreceptor in which durability is low since it tends to be adversely influenced by oxidizing gasses such as ozone and $NO_x$ though charge transport property is high and fundamental performance of charging and sensitivity properties of an electrophotographic photoreceptor using aforesaid photoreceptor is high and there by there are practical problems due to reduction of resolution and capable of maintaining the initial property for a long period can be provided.

We claim:

1. An electrophotographic photoreceptor comprising a charge transport material and an anti-oxidant in the charge transport layer wherein the transport material has a carbon atom of which charge density on the carbon atom in an aromatic ring is smaller than −0.16 when aforesaid charge transport material is in a positive hole state due to being one electron-oxidation, the anti-oxidant has oxidation potential satisfying Formula, $$0.1 \leq E_{OX} - E_T \leq 1.0$$

wherein $E_{OX}$ is oxidation potential of the anti-oxidant in volts, and $E_T$ is oxidation potential of the charge transport material in volts, and layer thickness of the charge transport layer is 25 μm or more.

2. The electrophotographic photoreceptor of claim 1 wherein the anti-oxidant is a compound having at least either a hindered amine structural unit or a hindered phenol structural unit in each molecule.

3. The electrophotographic photoreceptor of claim 1 wherein the charge transport layer is composed of plural layers, and an outermost layer of the plural layers contains the charge transport material and the anti-oxidant.

4. The electrophotographic photoreceptor of claim 1 wherein the charge transport is represented by formulas

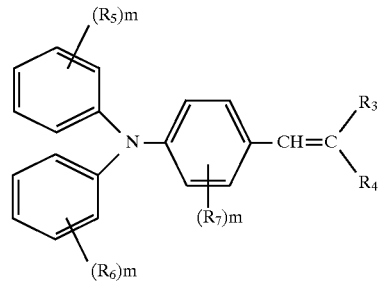

(A)

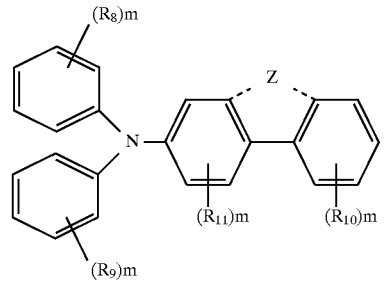

(B)

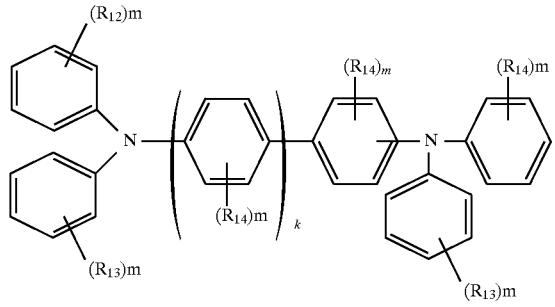

(C)

and

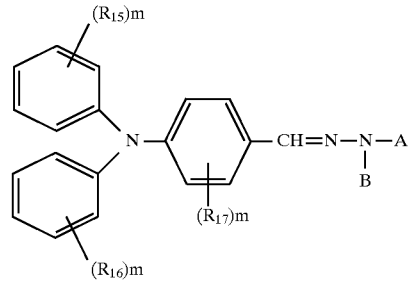

(D)

wherein $R_3$ is a phenyl group which may have a substituent, $R_4$ is a hudrogen atom or a phenyl group which may have a substituent, $R_5$ to $R_{17}$ are each represent a hydrogen atom, a halogen atom, alkyl group or alkoxy group, m is an integer of 1 to 3; A and B independently is an alkyl group which may have a substituent or a phenyl group which may have a substituent, and A and B may form a ring in combinanation each other; Z is a bonding group; and k is an integer of 0 or 1.

5. The electrophotographic photoreceptor of claim 4 wherein the charge transport material is represented by formulas (A).

6. The electrophotographic photoreceptor of claim 1 wherein the charge transport material is selected a group consisting of compounds (1) to (9),

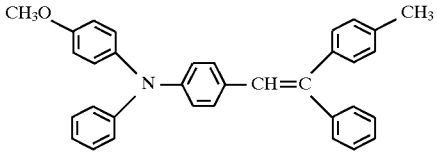

(1)

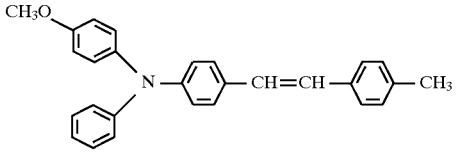

(2)

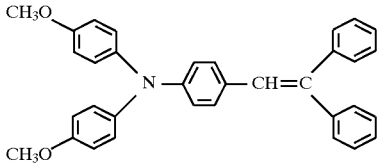

(3)

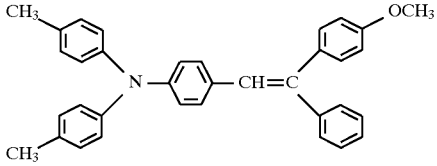

(4)

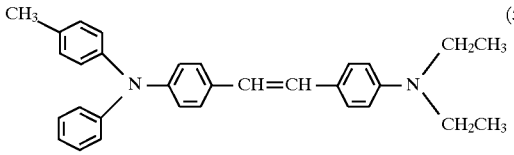

(5)

-continued

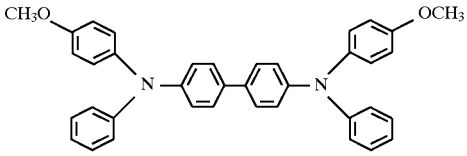

(6)

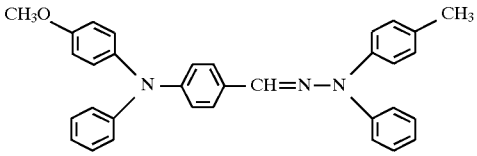

(7)

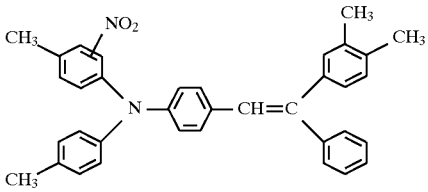

(8)

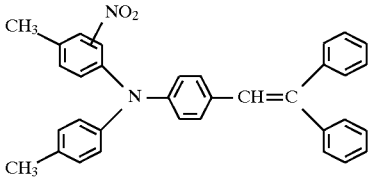

(9)

7. The electrophotographic photoreceptor of claim 1 wherein an amount of the anti-oxidant is 0.01–50 wt % of the charge transport material.

* * * * *